United States Patent [19]

Jones et al.

[11] Patent Number: 4,696,441

[45] Date of Patent: Sep. 29, 1987

[54] MISSILE REFERENCED BEAMRIDER

[75] Inventors: Michael M. Jones, Arab; Walter E. Miller, Jr.; Robert R. Mitchell, both of Huntsville, all of Ala.

[73] Assignee: The United States of America as represented by the Secretary of the Army, Washington, D.C.

[21] Appl. No.: 860,354

[22] Filed: May 6, 1986

[51] Int. Cl.[4] ..... F41G 7/26

[52] U.S. Cl. ..... 244/3.13

[58] Field of Search ..... 244/3.13

[56] References Cited

U.S. PATENT DOCUMENTS 3,028,807 4/1962 Burton et al. ..... 244/3.13
3,416,751 12/1968 Larson ..... 244/3.13
3,501,113 3/1970 Maclusky ..... 244/3.13
3,513,315 5/1970 Sundstrom et al. ..... 244/3.13

*Primary Examiner*—Charles T. Jordan
*Attorney, Agent, or Firm*—Freddie M. Bush; Robert C. Sims

[57] ABSTRACT

In accordance with this invention, a missile referenced beamrider guidance link is provided in which a continuous wave or pulsed laser output is formed into a gaussian cross section or similarly shaped beam and projected to one offset sensor, or to two sensors located on opposite sides and as far from the missile's roll axis as possible. The rolling missile motion amplitude modulates the received signal and the amplitude of the modulation is a measure of the missile's distance from beam axis. The phase of the modulation provides the direction to beam center.

4 Claims, 7 Drawing Figures

MISSILE REFERENCED BEAMRIDER

DEDICATORY CLAUSE

The invention described herein may be manufactured, used, and licensed by or for the Government for governmental purposes without the payment to us of any royalties thereon.

BACKGROUND OF THE INVENTION

Beamrider missile systems utilize a form of line of sight missile guidance in which a beam of spatially encoded electromagnetic radiation is projected in the direction of the target and a rearward-looking missile borne receiver decodes the spatial information and thereby determines the missile's position within the beam. The missile corrects its position as necessary to remain at or near the beam center until target impact.

The previously known forms of beamrider guidance have utilized spatial codes that are referenced to the beam projector and thus to the gunner's coordinate system. Such spatial codes are normally implemented with mechanical scan or nutation devices in the beam projector that produce this reference coordinate system for the missile receiver to decode. Transformation into missile coordinates prior to guidance command generation is then required unless the missile contains a roll stabilization system to minimize variation between projector and missile coordinate references.

It is the object of this invention to provide a spatial encoding technique that is totally independent of the beam projector roll orientation. This missile referenced spatial encoding method negates the need to either roll stabilize the missile, or to utilize a gyro for roll attitude measurement. This capability would be particularly desirable in lightweight, low cost, short range (350 to 750 meter maximum) missile systems. An inherent benefit of this invention, consistent with such system requirements, is the simple, no-moving-parts beam projector that is potentially a discardable item.

SUMMARY OF THE INVENTION

In accordance with this invention, a missile referenced beamrider guidance link is provided in which a continuous wave or pulsed laser output is formed into a gaussian cross section or similarly shaped beam and projected to one offset sensor, or to two sensors located on opposite sides and as far from the missile's roll axis as possible. In either case, the rolling missile motion amplitude modulates the received signal, the amplitude of which is a measure of the missile's distance from beam axis. The phase of the modulation provides the direction to beam center. The two sensor configuration provides a greater depth of modulation for a given missile position and thus, an improvement in signal to noise ratio. A single plane control system on a rolling missile is an ideal combination for this spatial code, thereby permitting minimization of both function and components in the ground based beam projector, in the missile borne decoding and guidance electronics, and in the control mechanism itself.

DETAILED DESCRIPTION OF THE PREFERRED EMBODIMENT AND BEST MODE

Figure 1:
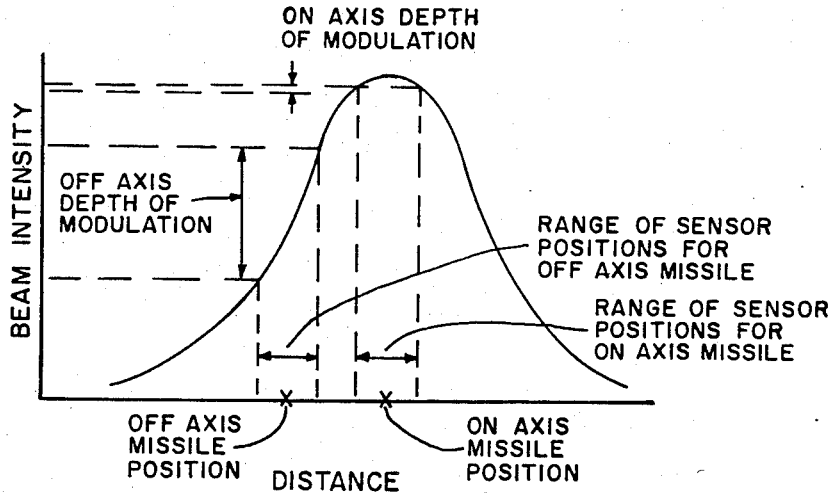
FIG. 1 illustrates the cross section of the guidance beam relative to intensity.
Figure 2:
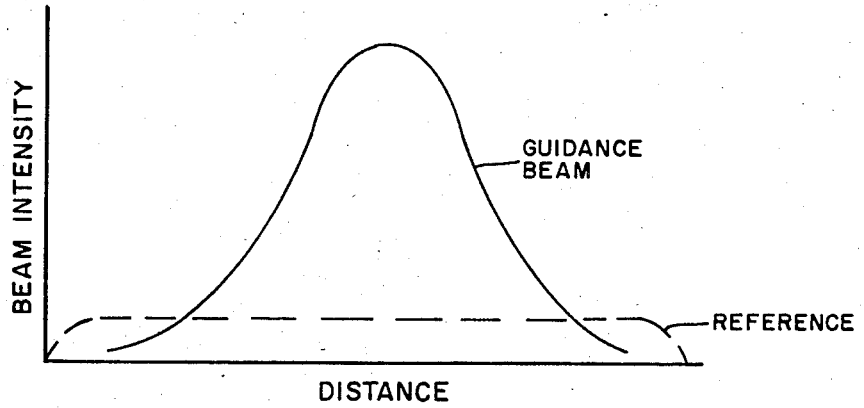
FIG. 2 illustrates the cross sections of guidance and performance beams.

FIG. 1 illustrates the spatial code in accordance with the invention. Two different missile positions within the guidance beam are depicted for a given range from the beam projector. The depth of modulation produced by the off axis, rolling missile is a function of the missile's distance from beam center as well as its range to the beam projector. An automatic open loop gain program located in the missile electronics will compensate for the effect of beam divergance as the missile flys down range. As shown, the depth of modulation approaches zero for a missile directly on the beam axis. In addition to the guidance beam which has a near Gaussian intensity distribution over its cross section, a reference beam is shown in FIG. 2 which is utilized in order to permit normalization of the substantial amplitude modulation resulting from atmospheric scintillation. The GaAs laser pulses are 120 nanoseconds wide at a few KHz PRF. A few microseconds (less than 10% of the time between pulses) after each signal beam output pulse, the reference beam, which has a near uniform intensity distribution over its cross section, is transmitted. The ratio of guidance to reference beam intensity provides a normalized, unscintillated measure of received energy.

Figure 3:
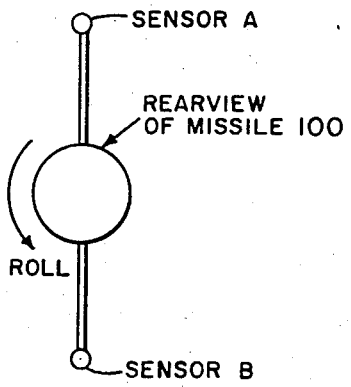
FIG. 3 illustrates the relative position of the sensors on the missile.

FIG. 3 illustrates the preferred sensor configuration on board the missile 100. Sensors A and B are placed as far from the center as possible. A variety of signal processing algorithms can be employed in the processing of the signals received at the two sensors.

The following examples have been subjected to simulation and testing and exhibit relative advantages and disadvantages depending on application. "S" and "R" refer to the "signal" or "reference" beam from which the processed voltage was derived while "a" and "b" refer to particular sensors. The voltage resulting from any one of these algorithms is the missile guidance signal.

1. (Sa/Ra)/(Sb/Rb)
2. (Sa/Ra)-(Sb/Rb)
3. (Sa-Sb)/(Ra-Rb)
4. (Sa-Ra)-(Sb-Rb)
5. Sa-Ra

Figure 4:
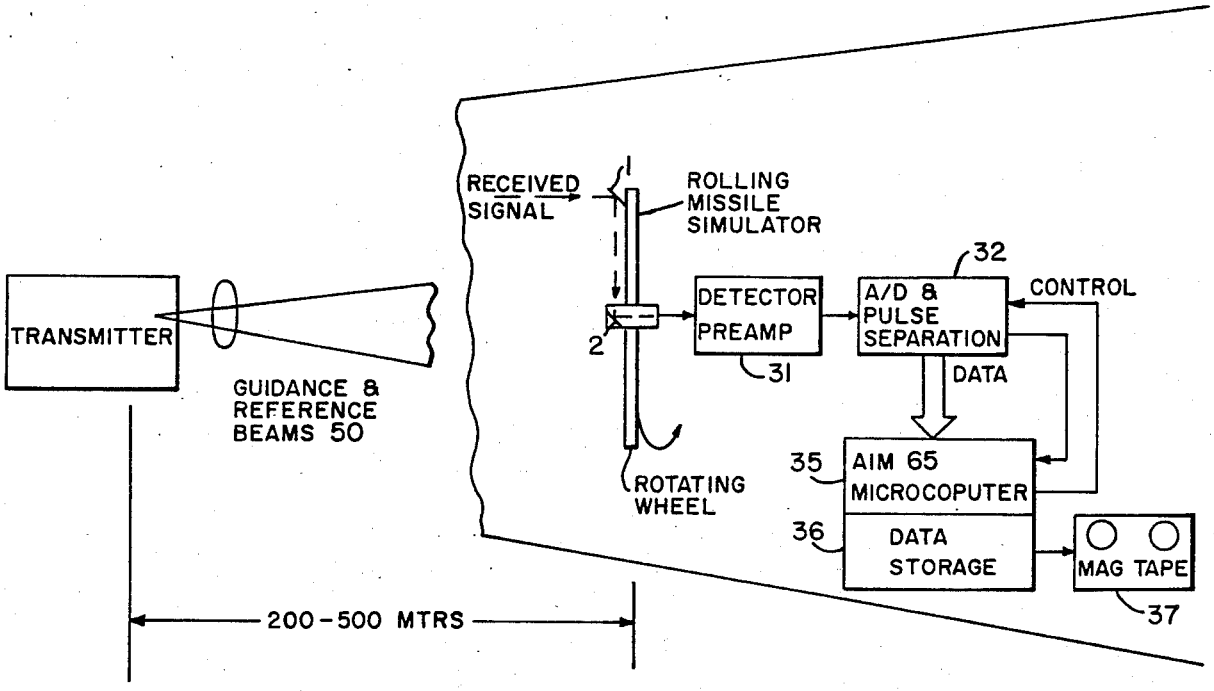
FIG. 4 illustrates a field test data acquisitions system in accordance with the present invention.
Figure 5:
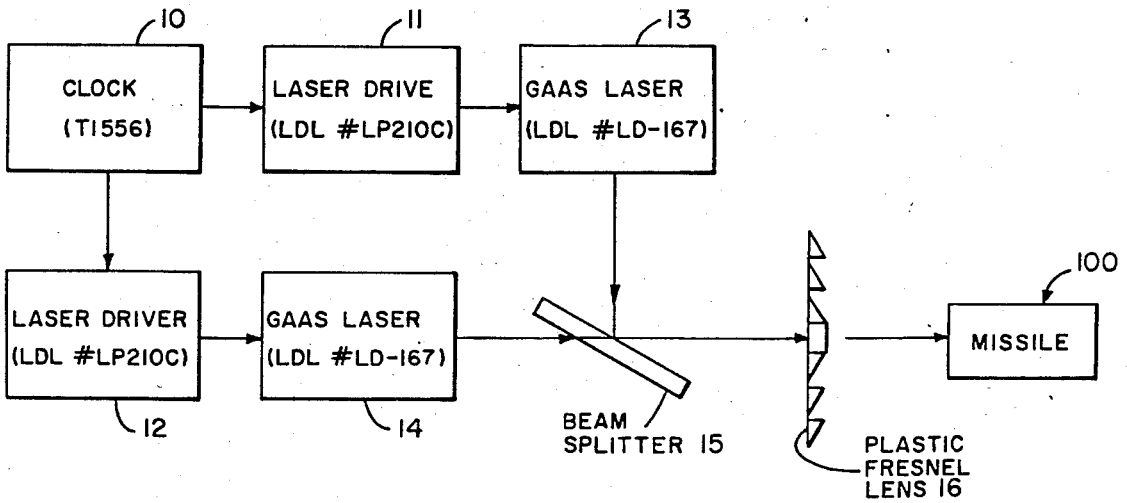
FIG. 5 illustrates in block diagram form the transmitter configuration as applied to the overall system.

FIG. 4 illustrates the hardware that was configured for the purpose of field testing. The transmitter is shown in FIG. 5. A clock 10 (TI 556) provides the timing for laser drives 11 and 12 (LDL#LP-210C). Two GaAs lasers 13 and 14 (LDL#LD-167) are adjustably located relative to beam splitter 15 and therefore from lens 16. Lens can take the shape of a plastic Fresnel lens. The gaussian guidance beam intensity distribution was obtained by defocusing the laser/objective pairs. The more uniform "reference" beam was obtained by further defocusing of the reference beam laser 13 relative to lens 16. The receiver configuration, in order to simplify the data acquisition system, utilized a single detector/preamp 31 as shown in FIG. 4. The "rolling missile simulator" depicted in FIG. 4 is further illustrated in FIGS. 6 and 7. This mechanical device was used for simulating the circular motion of the detector in the guidance field. Since the raw field test data (amplitudes of received guidance and reference pulses) would ultimately be transferred to a PDP-11 mini-computer for processing in the guidance simulation, it was decided to utilize a digitally formatted data storage device. An AIM-65 micro-computer 35 was selected for this purpose. An A/D and pulse separator 32 is used to input the computer 35. A 32K Data storage 36 reads this information to magnetic tape 37.

In application, one of the processing algorithms (1–5 above) would be used, implimented with either hardware or software, and the algorithm result is the missile position signal.

Figure 7:
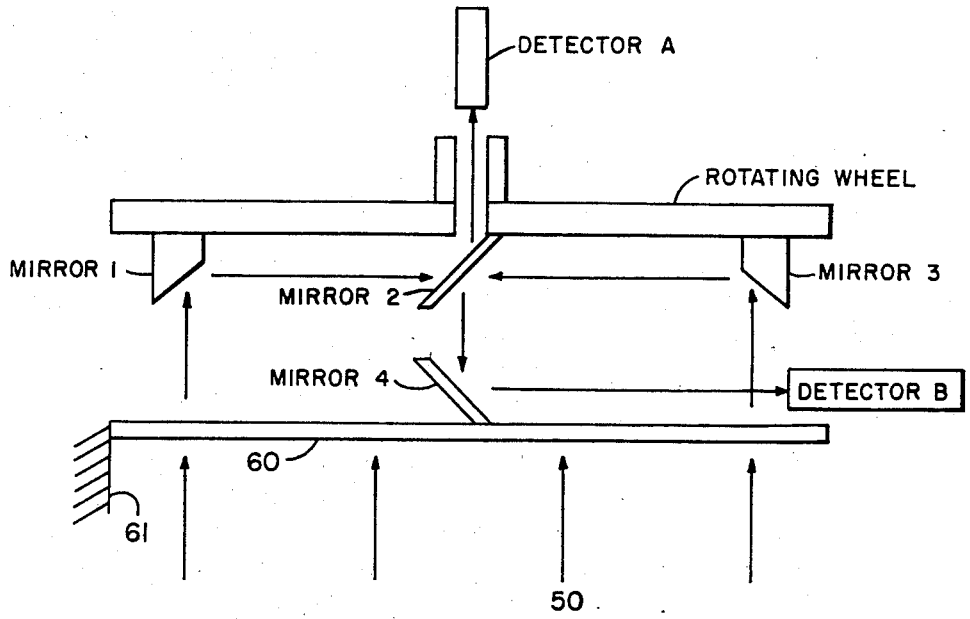
FIG. 6 and FIG. 7 illustrate views of the rotating wheel in accordance with the present invention.
Figure 6:
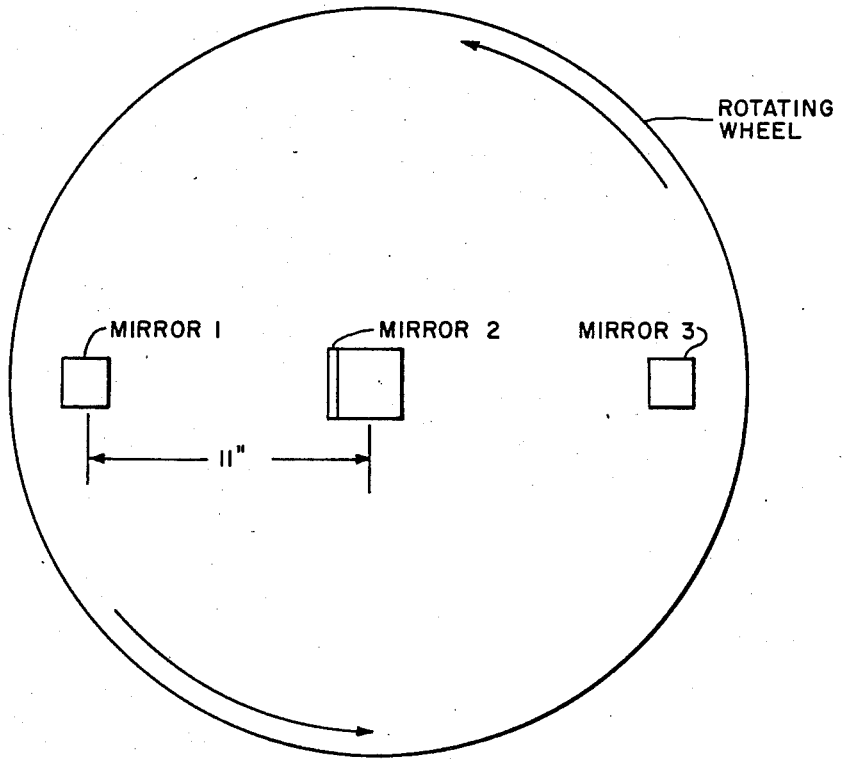

FIGS. 6 and 7 illustrate the rotating wheel used in testing the system. For the single sensor situation mirrors 1 and 2 are aligned such that the incoming guidance and reference beam 50 will strike mirror 1 as it is rotating about the beam and will be transferred to mirror 2 and on to detector A through the center of the wheel. For the two sensor configuration a transparent cover 60 is fixed in space to an attachment 61. A further mirror 3 is mounted on a rotating wheel 180° from mirror 1. Mirror 2 will be coated on both sides for reflecting signals. A forth mirror 4 is mounted on the transparent cover 60 so as to be in line with reflection from mirror 2. The incoming signal 50 will be reflected off of mirror 3 onto mirror 2 and then from mirror 2 onto mirror 4. There it will travel to the detector B. Both detectors are mounted in a fixed relationship and do not rotate with the wheel. Of course in a actual missile, the use of mirrors and rotating wheels will not be necessary as is shown in FIG. 3.

We claim:

1. A method for generating guidance signals to a rotating missile comprising the steps of generating and transmitting a guidance beam having a center position along which the missle is to be guided, said guidance beam having a cross section such that the amplitude of the intensity of the beam will decrease as a function of the distance from the center of the beam, locating a sensor off axis on said rotating missile for sensing said amplitude of said guidance beam and generating a modulation signal, detecting modulation signal of said sensor for generating a guidance signal, detecting phase of the modulation signal of said sensor for determining a pointing direction towards the center of said guidance beam; generating and transmitting a reference beam having a cross section in which there is no change in the amplitude of the intensity of the reference beam respective to distance from the center of the reference beam, and said sensor detecting this reference beam amplitude so that a function of the distance a missile is from the center of said guidance beam can be generated.

2. A system as set forth in claim 1 further comprising the steps of generating said guidance beam as a series of pulses separated by a predetermined amount of time, generating said reference beam as a series of pulses separated by the same predetermined amount of time, and generating the reference beam following said guidance beam at an amount of time less than 10% of said predetermined time.

3. A method as set forth in claim 2 further comprising the step of locating said sensor as far off from the center of said missile as is allowed by the configuration of the missile so as to increase the amount of modulation of said sensor.

4. A method as set forth in claim 3 further comprising the step of mounting a second sensor off axis of said missile and 180° away from said first mentioned sensor.

* * * * *